US007000809B1

(12) United States Patent
Stroud

(10) Patent No.: US 7,000,809 B1
(45) Date of Patent: Feb. 21, 2006

(54) MINI-FLASHLIGHT SLING

(76) Inventor: John Timothy Stroud, P.O. Box 4178, Belleview, FL (US) 34421-4178

( * ) Notice: Subject to any disclaimer, the term of this patent is extended or adjusted under 35 U.S.C. 154(b) by 63 days.

(21) Appl. No.: 10/441,622

(22) Filed: May 20, 2003

(51) Int. Cl.
*A45F 3/14* (2006.01)

(52) U.S. Cl. ..... 224/250

(58) Field of Classification Search ..... 224/250, 224/251, 150
See application file for complete search history.

(56) References Cited

U.S. PATENT DOCUMENTS

| | | | | | |
|---|---|---|---|---|---|
| 825,753 | A | * | 7/1906 | Paul | 224/103 |
| 2,812,123 | A | * | 11/1957 | Girton | 224/150 |
| 3,188,130 | A | * | 6/1965 | Pietrowicz | 294/74 |
| 3,600,734 | A | * | 8/1971 | Pollinger | 12/120.5 |
| 3,768,711 | A | * | 10/1973 | Wilkinson | 294/149 |
| 4,508,249 | A | | 4/1985 | Kotchy | |
| D305,803 | S | * | 1/1990 | Sutcliffe | D26/140 |
| 4,984,724 | A | * | 1/1991 | Johnston | 224/257 |
| 5,082,156 | A | * | 1/1992 | Braun | 224/220 |
| 5,154,506 | A | * | 10/1992 | Leard | 362/103 |
| 5,217,294 | A | * | 6/1993 | Liston | 362/105 |
| 5,277,347 | A | * | 1/1994 | Savard | 224/103 |
| 5,370,286 | A | * | 12/1994 | Newman | 224/578 |
| 5,437,401 | A | * | 8/1995 | Seltzer | 224/578 |
| 5,522,122 | A | * | 6/1996 | Turchick et al. | 24/335 |
| 5,601,356 | A | | 2/1997 | McWilliams | |
| 5,632,428 | A | * | 5/1997 | Weiss | 224/623 |
| 5,752,633 | A | * | 5/1998 | Antaki | 224/222 |
| 5,921,657 | A | | 7/1999 | Case | |
| 6,036,066 | A | * | 3/2000 | Giacona, III | 224/148.6 |
| 6,182,875 | B1 | * | 2/2001 | Fareghi | 224/259 |
| 6,317,938 | B1 | * | 11/2001 | Durette | 24/298 |
| 6,443,338 | B1 | * | 9/2002 | Giacona, III | 224/148.6 |

* cited by examiner

*Primary Examiner*—Stephen K. Cronin

(57) ABSTRACT

A flashlight holder is constructed from a securely closed loop of pliant line with moveable parts which may be positioned along said loop providing a means of accurately directing a light beam where needed while allowing free movement of both hands. The holder may be placed on a flat surface, belt loop, a belt, ones hand or attached to various objects for support or securement.

6 Claims, 10 Drawing Sheets

MINI-FLASHLIGHT SLING

FEDERALLY SPONSORED RESERCH

Not applicable

SEQUENCE LISTING OR PROGRAM

Not applicable

BACKGROUND

1. Field of Invention

The present invention relates to a sling for flashlights, specifically to a removable sling having means that allow user to attach and/or position a mini-flashlight in a variety of ways to accurately aim the light beam where needed while leaving both hands free.

2. Description of Prior Art

There are times when a flashlight is desirable and sometimes necessary to provide illumination in order to perform a task safely and correctly. In many cases the larger heavier and sometimes bulkier "C" cell and "D" cell flashlights can be replaced with a mini-flashlight that is accurately aimed.

Conventional mini-flashlights (consisting of a tubular construction containing either "AA" or "AAA" batteries and a light source at one end) have become popular choices for such purposes. They are often preferred over larger flashlights for their compact and lightweight construction and work well under most conditions. Their operation and maintenance is inexpensive as is their replacement.

However, the smaller a light source is; the closer it must be placed; and the more accurately it must be aimed, at object requiring illumination, to achieve greatest intensity.

Manufactures have been trying to solve this problem with both attachable and permanent devices for mini-flashlights leaving the user with either a bulkier flashlight or an extra item to carry with it. Many of the attachments available are designed for a particular make and model and can be somewhat expensive. Most are designed to perform a certain way and are usually limited to that application. But it seems, that none of them are able to adapt to the many different situations the user might encounter.

It is therefore, desirable to have a detachable, inexpensive, universal, holder and positioner for a mini-flashlight that adapts to different situations while securing it against loss or damage.

In the search for prior art nothing was found that resembled the art presented in this document.

Figure 1:
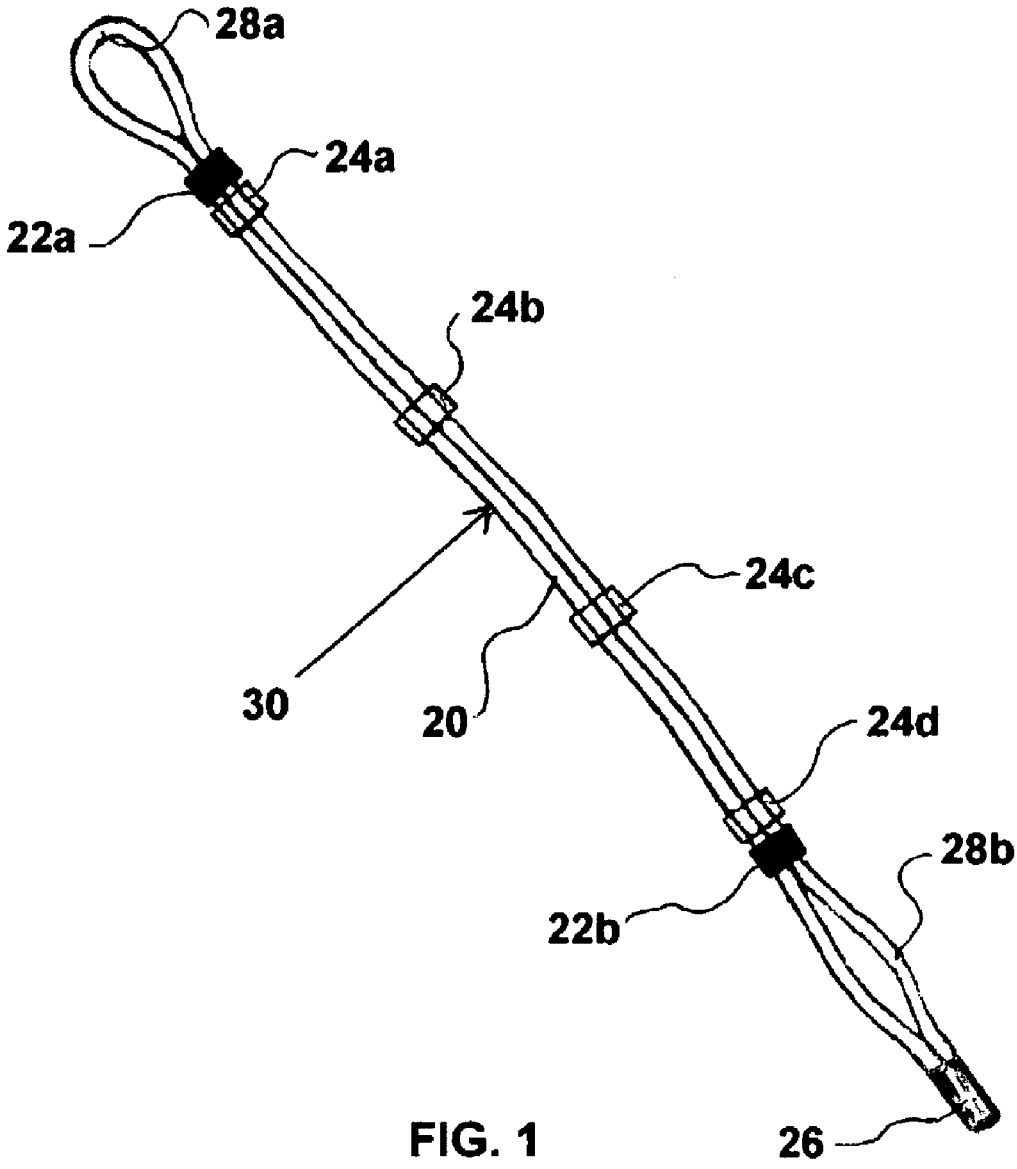
FIG. 1 is a (top) plan view of completed sling lying on a flat surface.

| REFERENCE NUMERALS IN DRAWINGS | |
|---|---|
| 10 | belt |
| 12 | belt loop |
| 14 | nail |
| 16 | pole |
| 18 | hand |
| 20 | pliant line |
| 22 | rubber slide |
| 24 | plastic slide |
| 26 | thin metal sleeve |
| 28a | bend end of line |
| 28b | crimped end of line |
| 30 | assembled sling |
| 32 | mini-flashlight |
| 40 | all-in-one tool |
| 42 | small camp shovel |
| 44 | plastic pipe |
| 46 | collapsible inspection mirror |

DESCRIPTION OF THE PREFERRED EMBODIMENT

Referring to FIGS. 1–10 the present invention relates to a sling 30 more specifically a sling 30 for a mini-flashlight 32. This flashlight 32 being of a tubular construction containing either "AA" or "AAA" batteries and having a light source at one end. Not being a part of the present embodiment mini-flashlight 32 is illustrated (Where shown) in phantom form and included only to show attachment of sling 30 and its operation thereof.

In reference to FIG. 1 the assembled sling 30 is shown by itself for simplicity of description of parts and their placement. In its preferred embodiment the sling 30 comprises four basic components: 1) pliant line 20 having rubber or plastic coating (like clothesline) cut to (but not limited to) a length of twenty-four inches (24"); 2) rubber slides 22*a* and 22*b* (presently made from rubber tubing) with inner diameter being a little under twice the diameter of line 20 and being at least an eighth-inch (⅛") in length; 3) plastic slides 24(*a–d*) (presently made from vinyl plastic tubing) with inner diameter being twice the diameter of line 20 and being at least a quarter-inch (¼") in length; 4) a secure bonding together of ends of line 20 by means of cast molding, or with attachments, fasteners, crimps or thin metal sleeves 26 crimped on ends.

Assembly of Parts

By placing the ends of line 20 parallel and pointing them in the same direction and bonding them together an elongated loop is formed.

A secure bonding can be (presently) achieved by inserting ends of line 20 into a thin metal sleeve 26 and crimping or mashing with moderate pressure. Sleeve 26 should be at least three-eighths-of-an-inch (⅜") in length.

Rubber slides 22*a* and 22*b* and plastic slides 24(*a–d*) (both being presently a quarter-inch (¼") in length) are moderately forced over bend end 28*a* of loop that is formed after bonding. Arrangement being an even number (four-to-six preferred) of plastic slides 24(*a–d*) being enclosed or sandwiched between two rubber slides 22*a* and 22*b*. They should fit tightly around doubled line 20 with rubber slides 22*a* and 22*b* (serving as thick rubber bands) being more difficult to move. Plastic slides 24(*a–d*) should be easily moved while maintaining position set by user.

Operation

Referring to FIG. 1 and then FIGS. 2–10. After assembly of sling 30 is completed, openings at ends 28*a* and 28*b* are created. These are the preferred locations for the insertion of ends of mini-flashlight 32. Showing mini-flashlight 32 in phantom form shows how mini-flashlight 32 is inserted into openings at ends 28*a* and 28*b* of sling 30. Once inserted the pushing of rubber slides 22*a* and 22*b* against mini-flashlight 32 constricts line 20 tightly around mini-flashlight 32 locking it to both ends of sling 30.

Referring now to FIGS. 3, 4, 6 and 7. An arch is created by sling 30 when attached to mini-flashlight 32. This arch aids in the accurate positioning of mini-flashlight 32 when attached or suspended.

Figure 3:
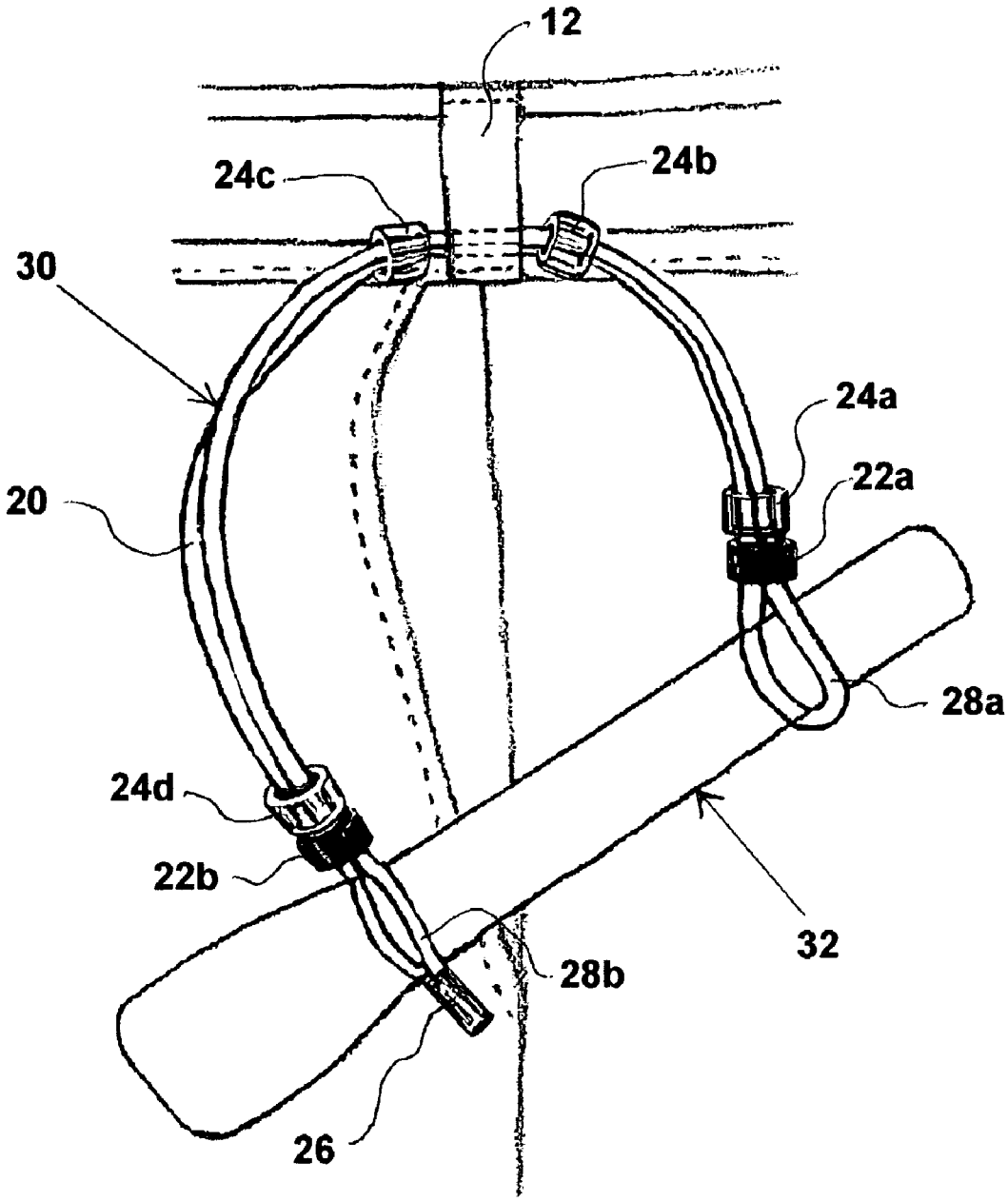
FIG. 3 is a perspective view of sling suspended from users left hip belt loop supporting (phantom) mini-flashlight at downward angle.

FIG. 3 shows how plastic slides 24*b* and 24*c* serve as stops to hold set position of mini-flashlight 32 while sling 30 is suspended from a belt loop 12.

Figure 4:
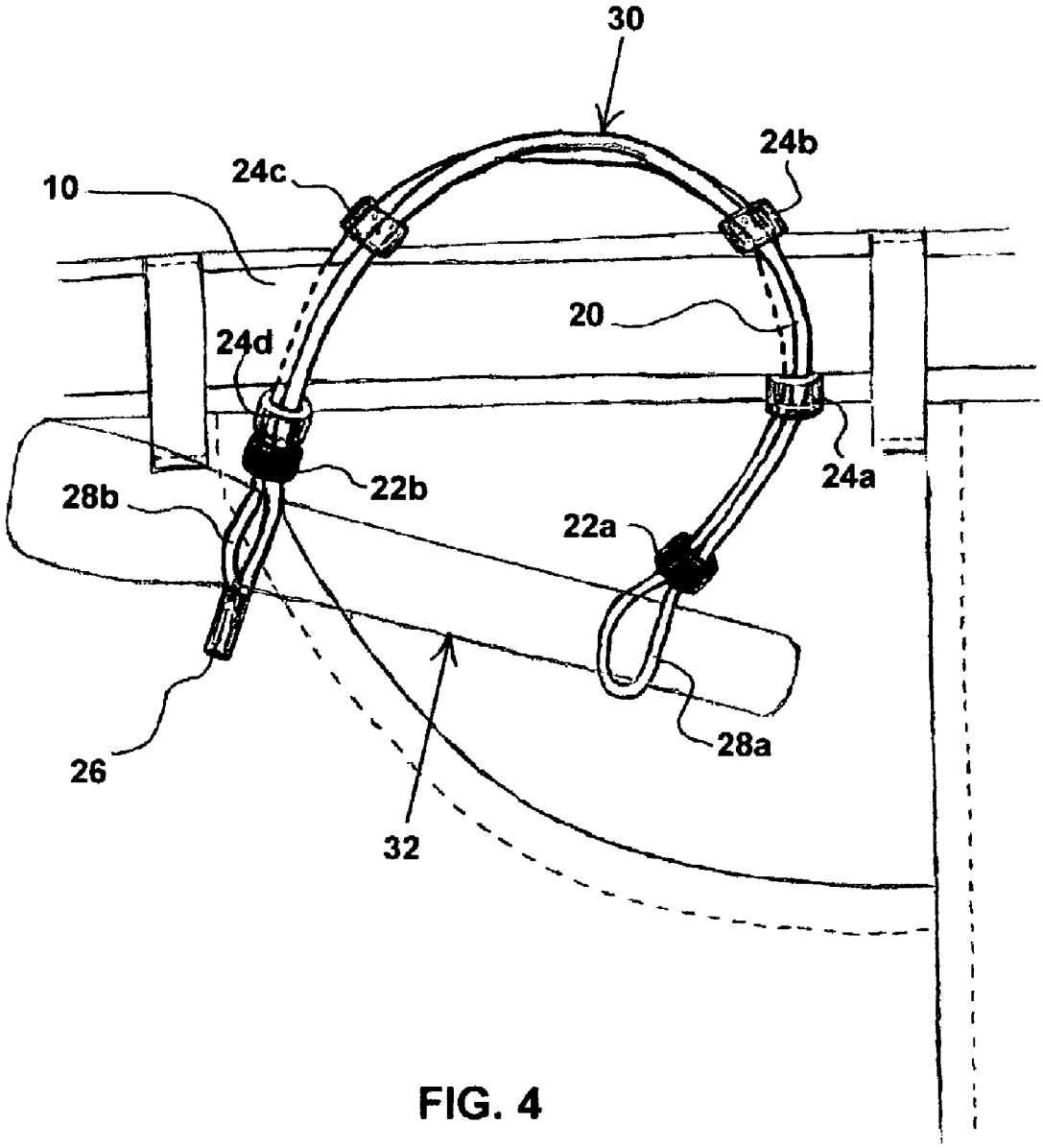
FIG. 4 is a perspective view of sling suspended from belt on users left side supporting (phantom) mini-flashlight at upward angle.

FIG. 4 shows mini-flashlight 32 being supported by sling 30 which has been passed through on both sides by a belt 10. Like rubber slides 22*a* and 22*b* plastic slides 24(*a–d*) can also constrict line 20 providing a means of attachment of sling 30. Because belt 10 is passed through looped line 20 plastic slides 24(*a–d*) can be pushed against belt 10 constricting line 20 tightly around it, for secure attachment.

Figure 6:
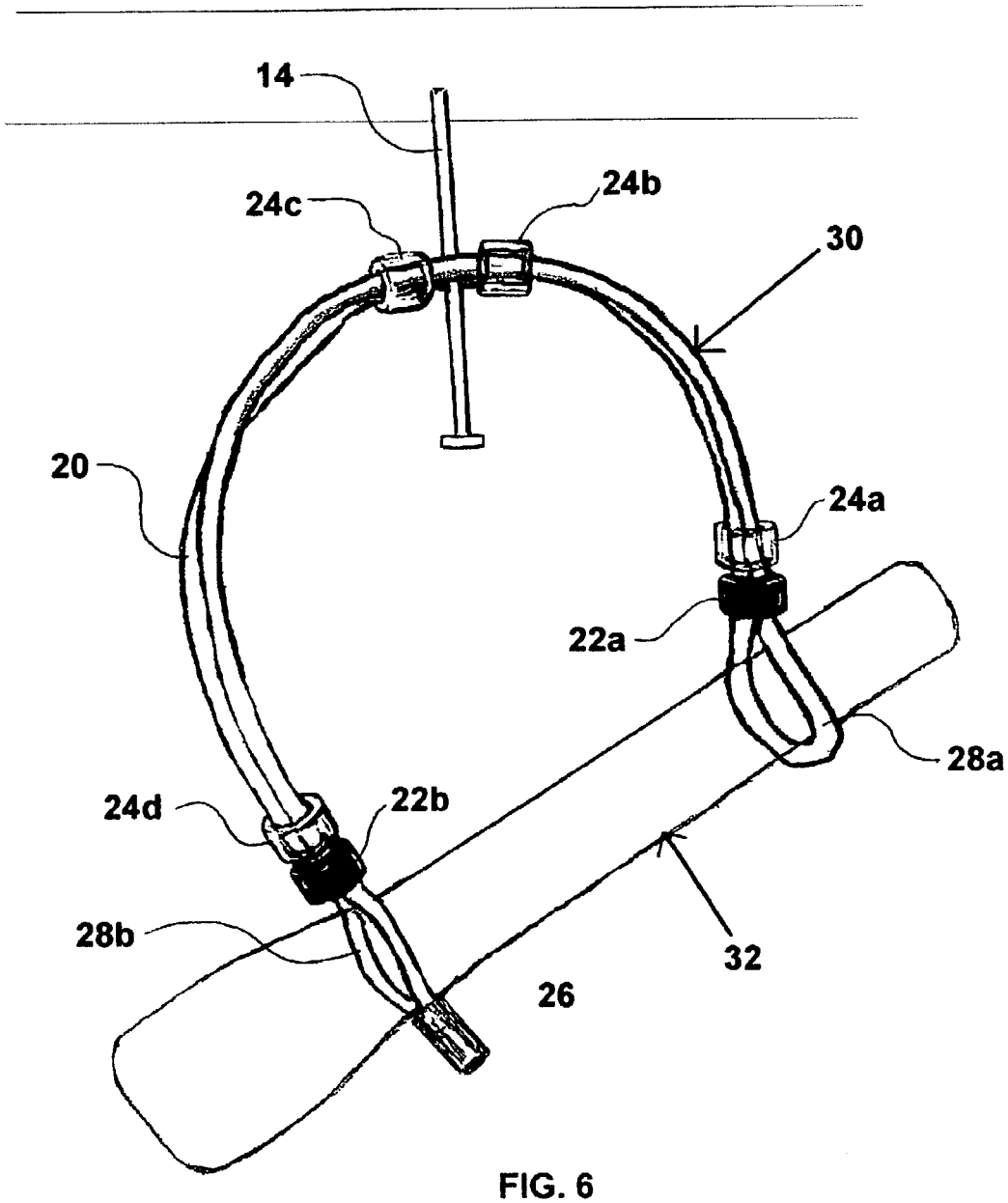
FIG. 6 is perspective view of sling attached to a nail and supporting (phantom) mini-flashlight at downward angle.

FIG. 6 shows how sling 30 can be attached to stationary objects like a driven nail 14 by tightly constricting line 20 around it with slides 24*b* and 24*c*. Some objects that are cylindrical in shape (like nail 14) can serve as a pivot, enabling sling 30 to rotate mini-flashlight 32 in a complete circle.

Figure 7:
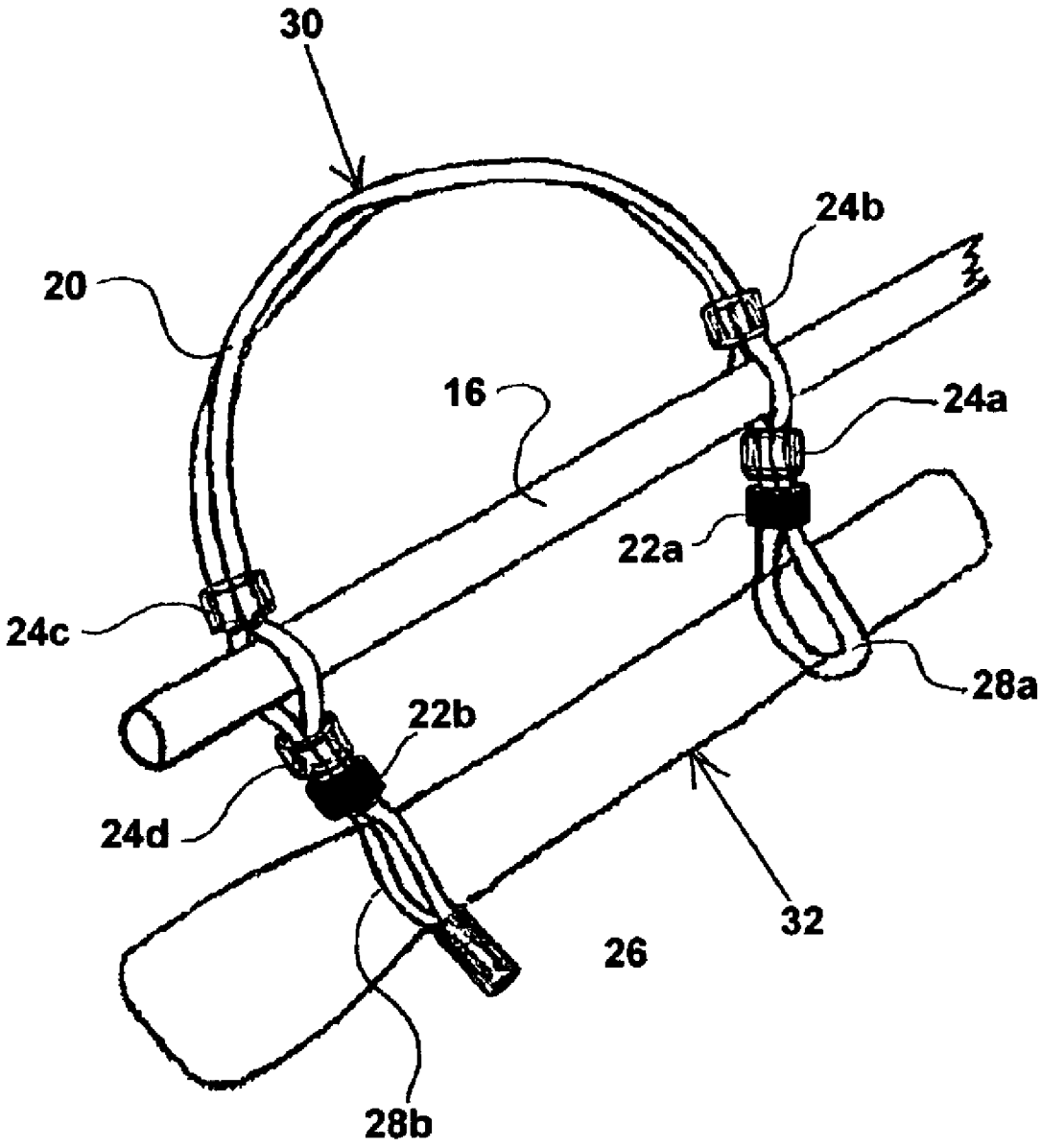
FIG. 7 is perspective view of sling attached to a pole and supporting (phantom) mini-flashlight at downward angle.

FIG. 7 shows how sling 30 can attach mini-flashlight 32 to a pole 16 for extension of reach or for a portable support. This allows user to extend light into areas that could be potentially dangerous to enter.

Figure 2:
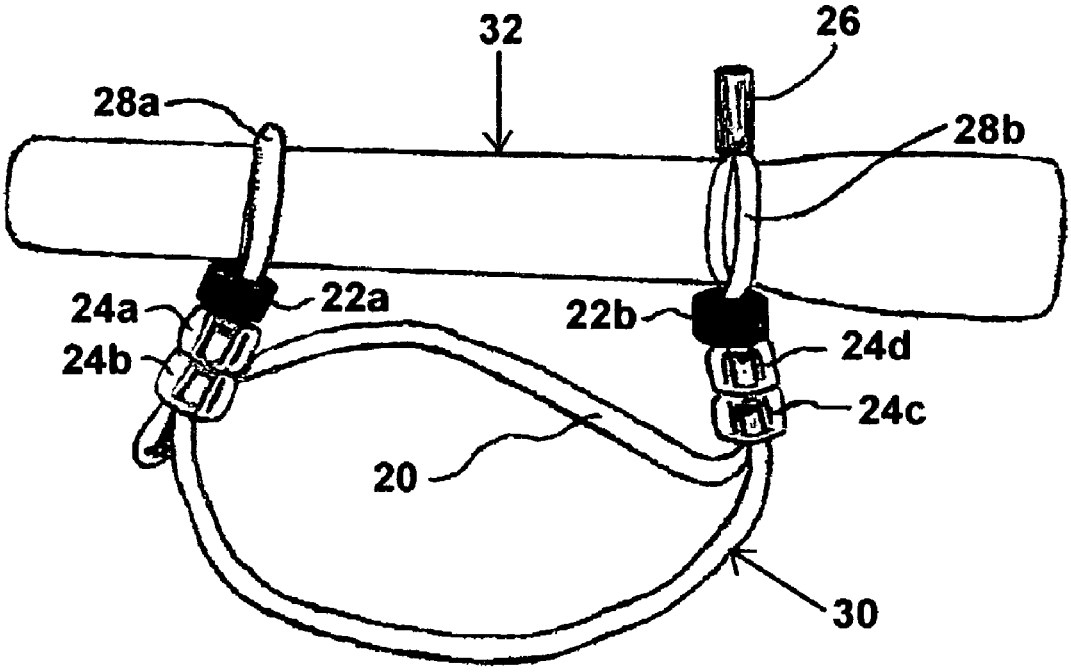
FIG. 2 is a perspective view of sling supporting a (phantom) mini-flashlight on a flat surface.
Figure 5:
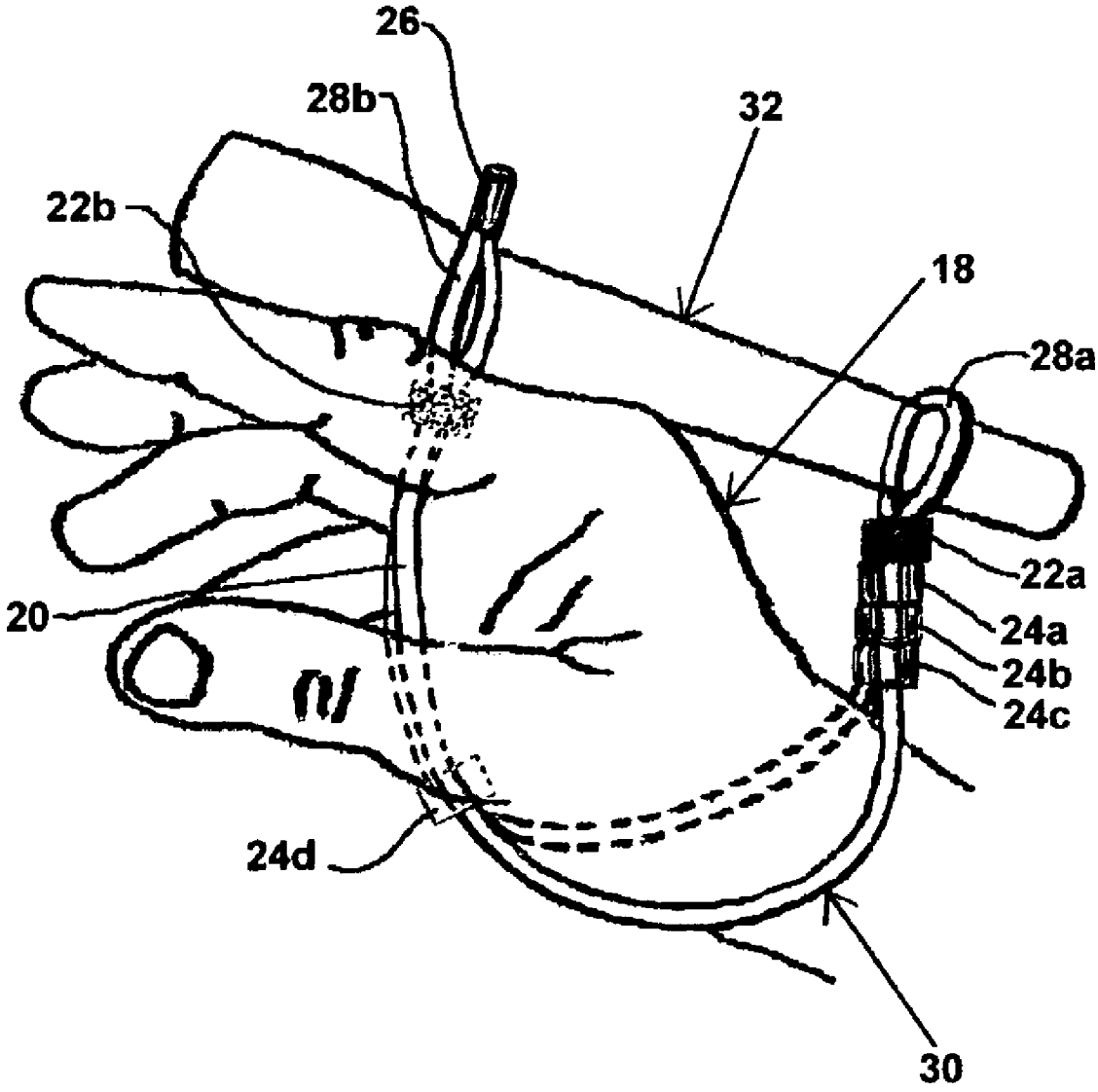
FIG. 5 is a perspective view of a (phantom) mini-flashlight being supported by sling with users right hand inserted.

Referring now to FIG. 2 and then FIG. 5. FIG. 2 shows how sling 30 can be formed into a stand for supporting mini-flashlight 32 on a flat surface. By equally separating and moving plastic slides 24(*a–d*) to ends 28*a* and 28*b* of sling 30, line 20 flashlight 32. Moving loop ends 28*a* and 28*b* independently along the mini-flashlight 32 can vary the balance and light angle of mini-flashlight 32.

FIG. 5 shows this same arrangement allowing the insertion of ones hand 18 through the circular or oval opening created by separating line 20. Moving one or more of the plastic slides 24(*a–d*) (slide 24*d* being partially shown) close to the wrist, constricts line 20 around the wrist creating a tighter fit. This arrangement allows user close concentrated lighting and freedom of both hands.

Figure 8:
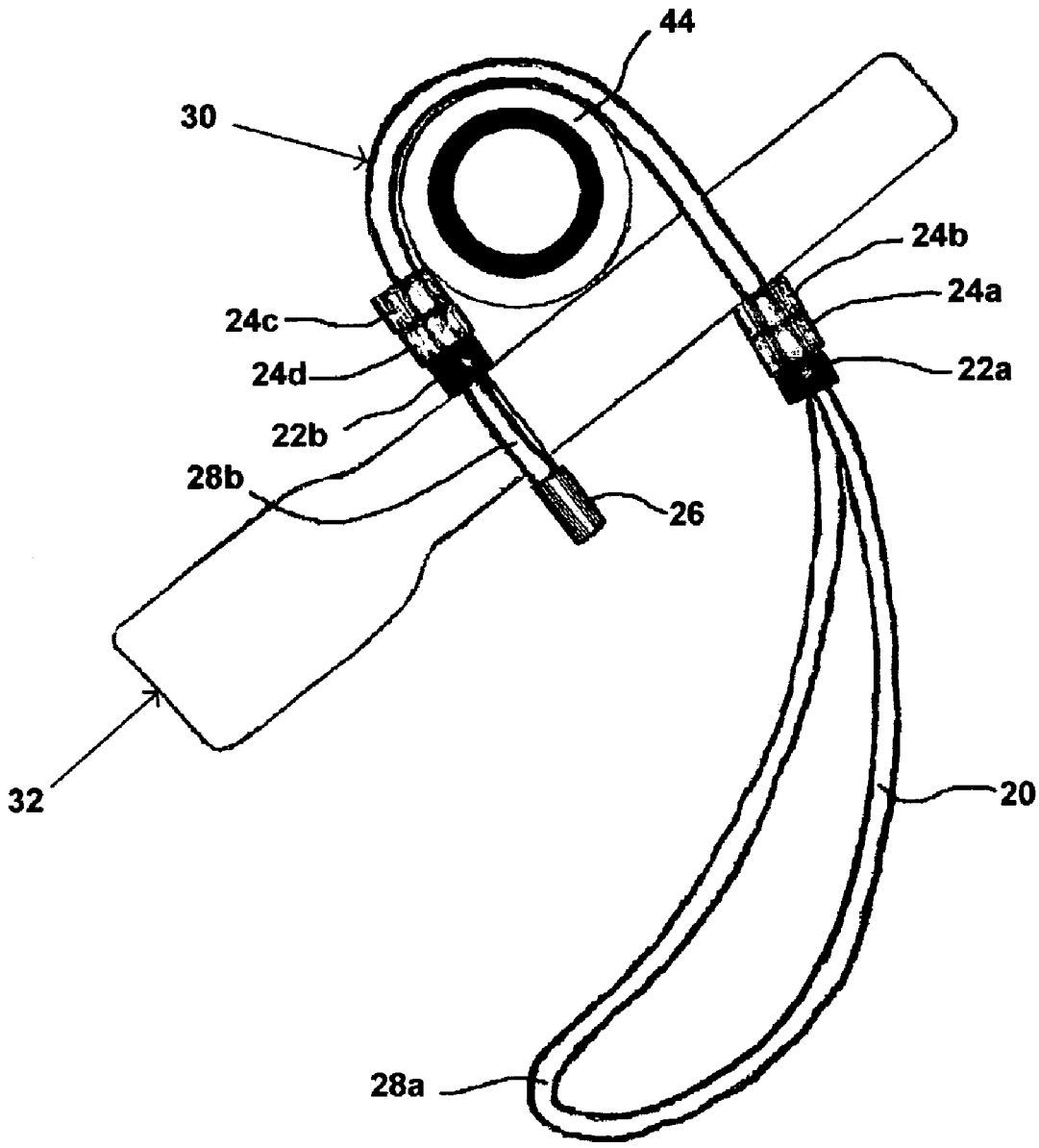
FIG. 8 is a plan view of left side of (phantom) mini-flashlight secured to a plastic pipe (as seen from end) by sling.
Figure 9:
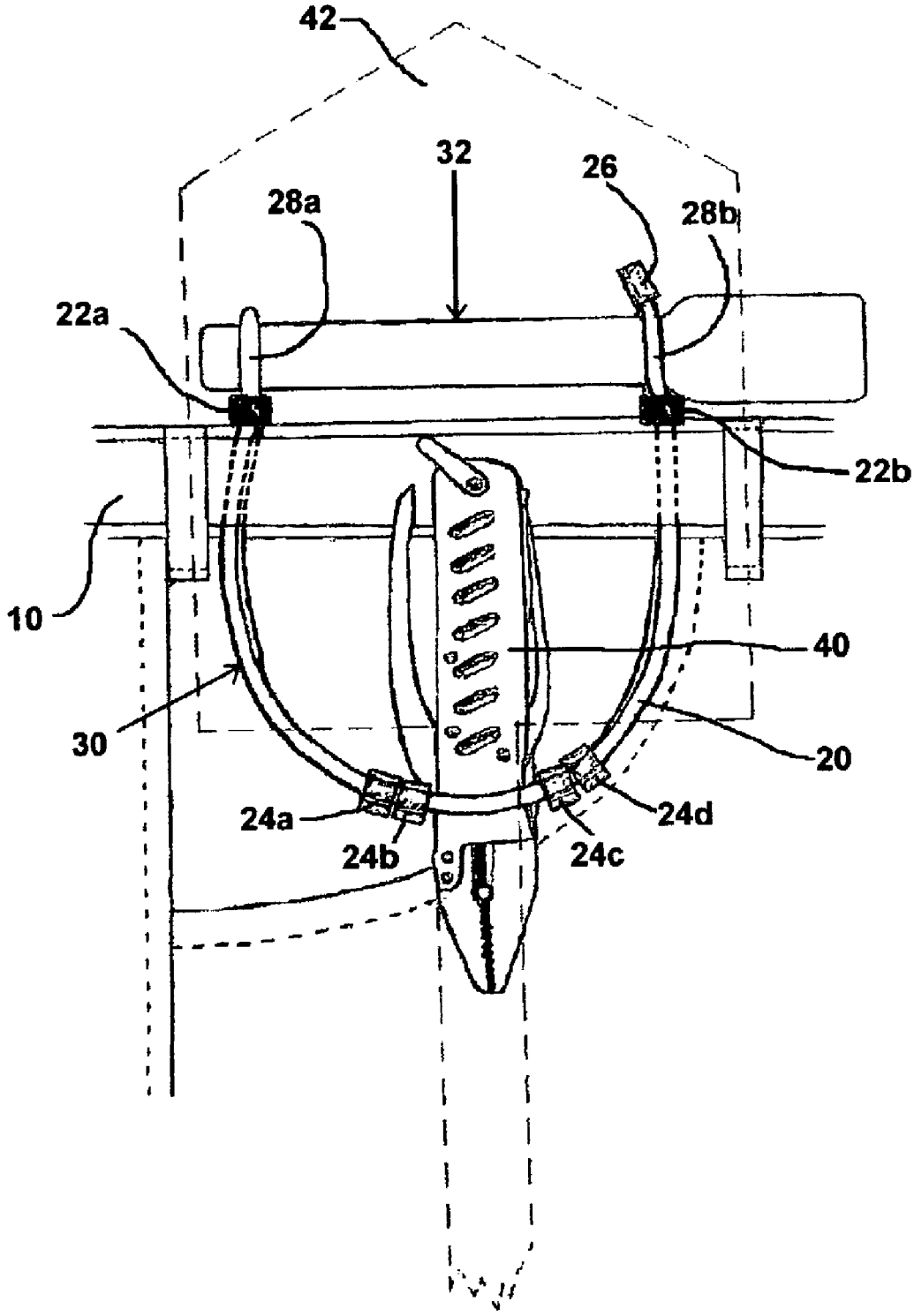
FIG. 9 is a plan view of right side of (phantom) mini-flashlight suspending sling below belt at users right hip supporting a small camp shovel (indicated by dashed lines) and an all-in-one tool.
Figure 10:
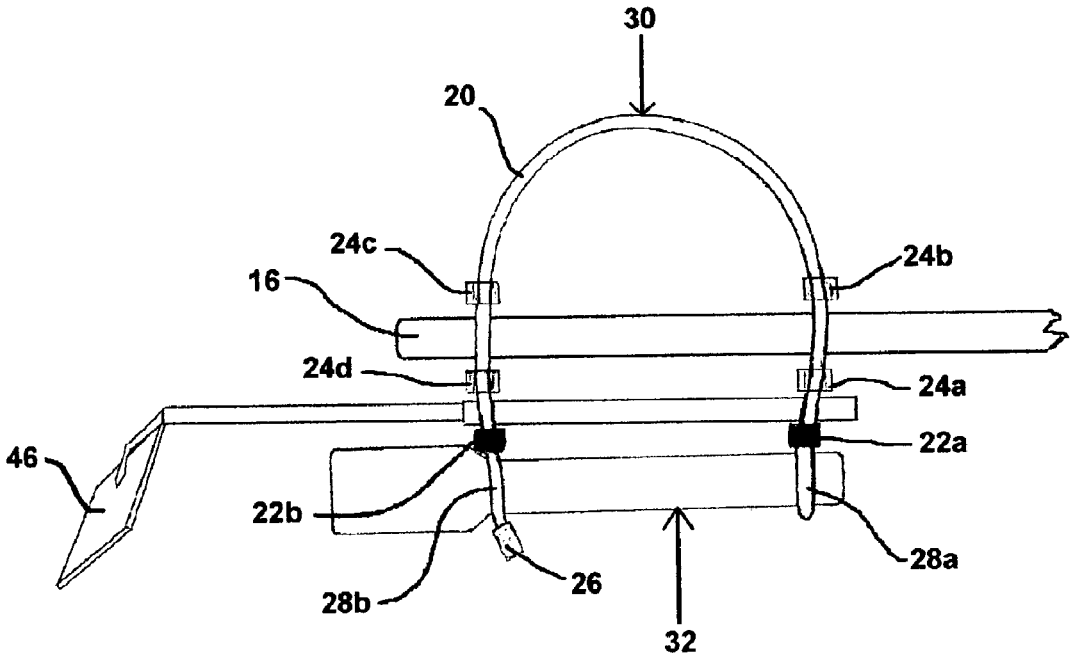
FIG. 10 is a plan view of sling supporting (phantom) mini-flashlight and collapsible inspection mirror while attached to a pole (as seen from left).

FIGS. 8,9, and 10 are included to illustrate the adaptability of sling 30 for other uses.

In FIG. 8 a mini-flashlight 32 is securely mounted to plastic pipe 44 (as seen from end). This shows how user can insert the end of a mini-flashlight 32 anywhere along length of sling 30. Pushing the plastic slides 24*a* and 24*b* and remaining rubber slide 22*a* against mini-flashlight 32 locks assembly in place. This works because line 20 is pliant and will conform to the shape of object it is wrapped around, allowing for tighter mounting. This method can be used for attaching assembly to the grip of a cordless drill/driver.

Referring to FIG. 9. Sling 30 is shown tucked behind user's belt 10 with mini-flashlight 32 suspending it below belt 10 forming a loop suitable for carrying some tools. This loop can support a small camp shovel 42, (depicted by dashed lines showing placement) hatchet, hammer or the like. An all-in-one tool 40, or the like, can be secured within sling 30 using plastic slides 24(*a–d*) to constrict line 20 firmly around it. With mini-flashlight 32 positioned along hip it can still provide directional light for user.

Referring now to FIG. 10. Attachment of a mini-flashlight 32 to a pole 16 was shown in FIG. 7. What wasn't shown was the ability of the sling 30 to secure yet, another item. FIG. 10 illustrates the addition of a collapsible inspection mirror 46. This can be very useful for inspecting underneath a vehicle or home, whereas, the usual routine involves groveling around on your back and hoping nothing leaps on you, or falls on your face.

In this document and the included illustrations I have tried to cover the basic functionality of the assembly described herein. It would take an album stuffed with photos to show all of its capabilities. Only in usage and experimentation will the many assets of this assembly be revealed.

It should also be pointed out that the constricting ability that enables the attachment of assembly, also qualifies it to receive other items, such as; a suction cup, a hook, a clamp, a magnet or cordage. In combining all this information it should be realized that this assembly is one of the most universally adaptable devices for attaching, positioning and holding a mini-flashlight.

While a preferred embodiment has been shown and described, it will be understood that it is not intended to limit the disclosure, but rather it is intended to cover all modifications and alternate methods falling within the spirit and the scope of the invention as described in the appended claims.

Having thus described the aforementioned invention,

I claim:

1. A hand tool providing easy handling comprising:

an elongated tool body;

a tool support comprising a loop of pliant line;

the loop encircling the tool body at a first loop end;

the loop encircling the tool body at a second loop end;

a first slide constricting the first loop end tightly about the tool body;

a second slide constricting the second loop end tightly about the tool body;

the first and second slide both slidable on the loop to loosen the loop about the tool body in an adjusting condition;

a third and fourth slide, each constricting the loop between the first and second slide and slidable on the loop, and wherein:

the tool is a flashlight; and the loop is configured to enable forming a vertical stand for supporting the flashlight body above a flat surface in a first condition, and in a second condition enable opening the loop to allow inserting therein a human hand snugly between the first and second end while maintaining the flashlight body adjacent the back of the hand in the second condition.

2. A hand tool, according to claim 1, and wherein:

the pliant line has a length of 24 inches.

3. A hand tool, according to claim 1, and further comprising:

the third and fourth slide slidable with less force than the first and second slide.

4. A hand tool, according to claim 3, and wherein a fifth and sixth slide, each constricting the loop between the first and second slide and slidable on the loop.

5. A hand tool providing easy handling comprising:

an elongated tool body;

a tool support comprising a loop of pliant line;

the loop encircling the tool body at a first loop end;

the loop encircling the tool body at a second loop end;

a first slide constricting the first loop end tightly about the tool body;

a second slide constricting the second loop end tightly about the tool body;

the first and second slide both slidable on the loop to loosen the loop about the tool body in an adjusting condition;

a third and fourth slide each constricting the loop between the first and second slide and slidable on the loop, the third and fourth slide slidable with less force than the first and second slide;

a fifth and sixth slide, each constricting the loop between the first and second slide and slidable on the loop, and wherein:

the first and second slide each comprise rubber, and the third and fourth slide each comprise plastic.

6. A method of securing an elongated flashlight to the back of a user's hand to enable directing the flashlight without encumbering the fingers of the hand, comprising:

encircling tightly an elongated flashlight with a loop of line at two separated locations on the flashlight;

inserting a user's hand through the loop between the two points;

positioning the loop between two fingers of the user's hand; and constricting the loop between the user's fingers and wrist to secure the loop snugly about the user's wrist.

* * * * *